US010968403B2

(12) United States Patent
Moore

(10) Patent No.: US 10,968,403 B2
(45) Date of Patent: Apr. 6, 2021

(54) HYDROCRACKER ACTIVITY MANAGEMENT

(71) Applicant: Marathon Petroleum Company LP, Findlay, OH (US)

(72) Inventor: Howard Moore, Ashland, KY (US)

(73) Assignee: Marathon Petroleum Company LP, Findlay, OH (US)

( * ) Notice: Subject to any disclaimer, the term of this patent is extended or adjusted under 35 U.S.C. 154(b) by 0 days.

(21) Appl. No.: 15/864,516

(22) Filed: Jan. 8, 2018

(65) Prior Publication Data

US 2018/0208860 A1 Jul. 26, 2018

Related U.S. Application Data

(60) Provisional application No. 62/445,478, filed on Jan. 12, 2017.

(51) Int. Cl.

*C10G 45/02* (2006.01)
*C10G 55/00* (2006.01)
*C10G 65/00* (2006.01)

(52) U.S. Cl.

CPC ..... *C10G 45/02* (2013.01); *C10G 2300/1059* (2013.01); *C10G 2300/202* (2013.01); *C10G 2300/205* (2013.01)

(58) Field of Classification Search

CPC ..... C10G 55/02; C10G 55/06; C10G 45/02; C10G 2300/202; C10G 2300/205; C10G 2300/1059

See application file for complete search history.

(56) References Cited

U.S. PATENT DOCUMENTS

| | | | | |
|---|---|---|---|---|
| 3,720,601 | A | 3/1973 | Coonradt | |
| 3,795,607 | A | 3/1974 | Adams | |
| 5,009,768 | A * | 4/1991 | Galiasso | C10G 65/12 208/210 |
| 5,417,846 | A * | 5/1995 | Renard | C10G 67/06 208/210 |
| 8,066,867 | B2 | 11/2011 | Dziabala | |
| 8,404,103 | B2 | 3/2013 | Dziabala | |
| 2007/0215521 | A1 * | 9/2007 | Havlik | C10G 2/30 208/80 |
| 2015/0057477 | A1 * | 2/2015 | Ellig | C10G 3/50 585/252 |
| 2018/0179457 | A1 * | 6/2018 | Mukherjee | B01D 1/28 |

FOREIGN PATENT DOCUMENTS

| | | |
|---|---|---|
| EP | 0949318 | 10/1999 |

* cited by examiner

*Primary Examiner* — Prem C Singh
*Assistant Examiner* — Juan C Valencia
(74) *Attorney, Agent, or Firm* — Womble Bond Dickinson (US) LLP

(57) ABSTRACT

In a hydrocracking process, the hydrocarbon feed is processed by a guard reactor operating at maximum severity temperatures. The processing in the guard reactor maximizes the removal of metals and performs hydrodenitrogenation steps and hydrodesulfurization steps. The demetallized and partially desulfurized and denitrogenized hydrocarbon feed is then sent to a treating reactor for further hydrodenitrogenation and hydrodesulfurization before being sent further downstream for further hydrocracking processing.

20 Claims, 1 Drawing Sheet

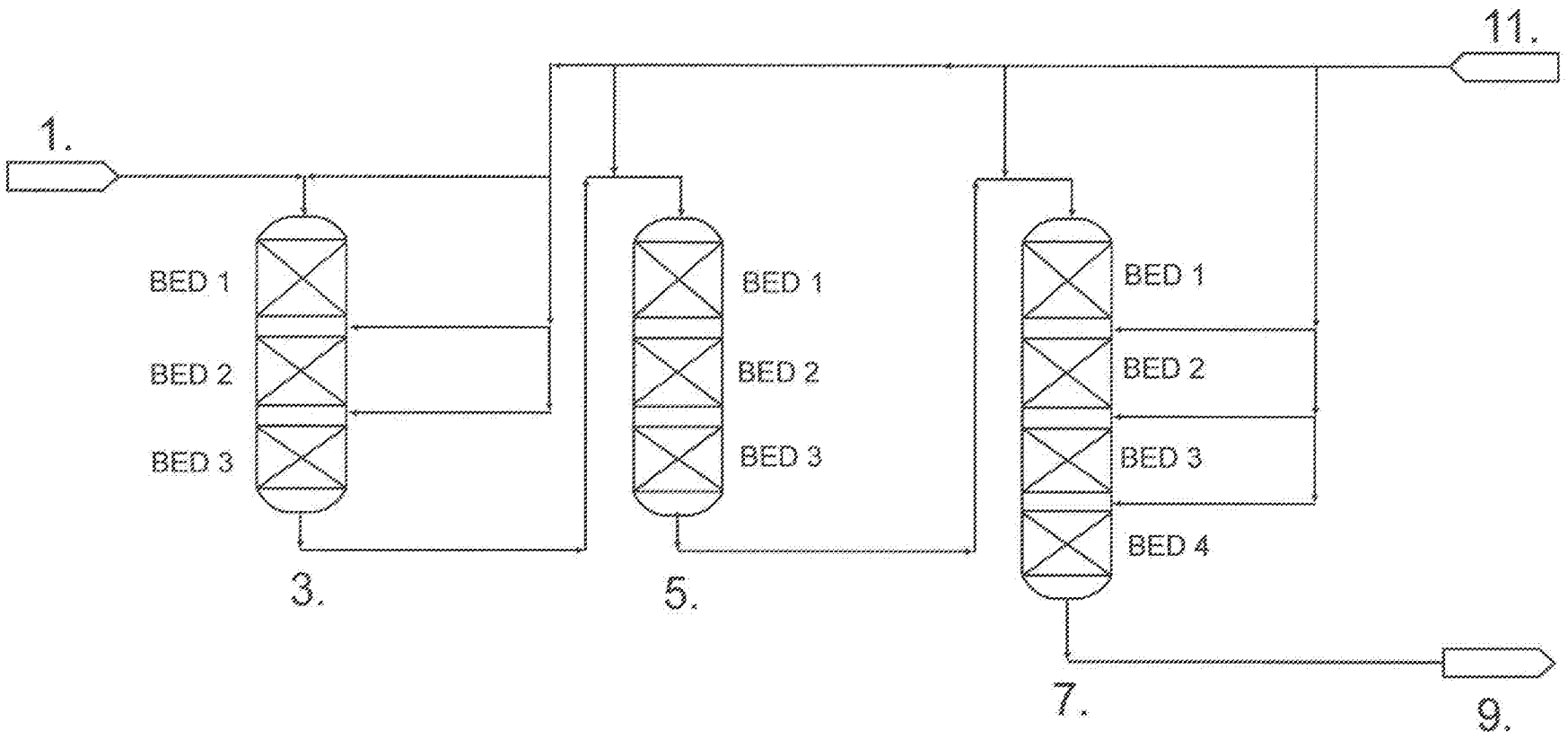
11.
9.
BED 1
BED 2
BED 3
BED 4
7.
BED 1
BED 2
BED 3
5.
BED 1
BED 2
BED 3
3.
1.

HYDROCRACKER ACTIVITY MANAGEMENT

CROSS REFERENCE TO RELATED APPLICATION

The present patent application claims the benefit of U.S. provisional patent application No. 62/445,478 filed Jan. 12, 2017.

BACKGROUND OF THE INVENTION

Hydrocracking is a catalytic chemical process used in petroleum refineries for converting the high boiling point constituent hydrocarbons in petroleum crude oils to more valuable lower boiling point products such as gasoline, kerosene, jet fuel and diesel oil. The process, utilizing elevated temperatures and pressures, cracks the high boiling point hydrocarbons into lower boiling point, lower molecular weight olafactic and aromatic hydrocarbons and then hydrogenates them.

It is well known that gas oil, such as crude oil, heavy petroleum products, coker gas oils, products from extraction and/or liquefaction of coal and lignite, products from tar sands, products from shale oil and similar products may contain metals such as vanadium, nickel, iron, silicon, and arsenic. When these hydrocarbon-containing feeds are fractionated, the metals tend to concentrate in the heavier fractions such as the topped crude and residuum. The presence of these metals makes further processing of these heavier fractions difficult since the metals generally act as poisons for the catalysts employed in downstream processes such as catalytic cracking, hydrogenation, hydrodesulfurization or hydrodenitrogenation. A guard reactor may be employed to remove these metals from hydrocarbon-containing feeds, prior to exposing those feeds to further treatment.

Gas oil also commonly contains undesirable levels of nitrogen and sulfur. The nitrogen is removed by a process known as Hydrodenitrogenation (HDN). The sulfur is removed by a process known as Hydrodesulfurization (HDS).

Hydrodenitrogenation (HDN) is an industrial process for the removal of nitrogen from petroleum). Organonitrogen compounds are undesirable because they will poison downstream catalyst. Furthermore, upon combustion organonitrogen compounds generate nitric oxide and nitrogen dioxide, pollutants.

hydrodesulfurization (HDS) is a catalytic chemical process used to remove sulfur from refined petroleum products and natural gas. The sulfur is removed to remove the sulfur dioxide emissions that result from using those fuels in combustion engines or oil burning furnaces. Further, sulfur if left unremoved, untreated or removed can poison metal catalyst (platinum and uranium).

Nitrogen and sulfur in a feedstock will poison the downstream hydrocarbons process if they are not removed from the feedstock. A treating reactor is employed to remove or significantly reduce nitrogen and sulfur levels prior to downstream refinery processes. Conventional refining practices utilize a guard reactor to capture the unintended materials, coupled with a treating reactor to perform HDN and HDS, prior to further downstream processing of the crude oil. The guard reactor contains a demetallization catalyst. The treating reactor is a hydrotreating reactor that has catalyst specifically to remove nitrogen and sulfur and other saturates aromatics to set up the crude oil for conversion in the hydrocracking reactor. The guard reactor protects the treating reactor from unwanted metals in the crude oil so the treating reactor can perform at maximum levels to prepare the crude oil feed for hydrocracking. Conventional refining operations maximizes metal recovery by keeping the guard reactor operating temperature as low as possible, thus lowering the deactivation rate of the HDN/HDS in the guard reactor.

Many petroleum refineries are tasked with processing heavy oils or even extra heavy oils given the current oil reserves and new discoveries taking place in the market. These heavy oils tend to have an increased nitrogen content. Nitrogen is known to have a significant negative kinetic effect on hydrotreating reactions like HDS. Further, the bed of a treating reactor will become saturated with nitrogen before the sulfur limit is reached, this allows nitrogen to pass the treating reactor known as nitrogen slip.

When processing heavy oils the treating reactor must be shut down for catalyst renewal with necessary undesirable frequency. Given the increase in hydroprocessing of heavy oils and their increased nitrogen levels, there is a need in the industry to extend the life of the treating reactor by reducing the nitrogen content contained in the heavy oils.

In the hydroprocessing system the treating reactor is considered the limiting factor as the beds of the treating reactor tend to become saturated quicker than that of a guard reactor. Within the treating reactor the HDN process is lost first and is therefore considered a limiting factor in the hydroprocessing system.

SUMMARY OF THE INVENTION

Conventionally a guard reactor is utilized to remove metals prior to the feedstock entering the treating reactor. Inside the treating reactor, sulfur and nitrogen are removed through HDN and HDS to prepare the feedstock for downstream processing. This conventional methodology is more difficult with the heavy, waxy, viscous oils currently being processed. The industry belief has been that lower guard reactor temperatures maximize metal capture by the guard catalyst material. This concept of lower temperatures maximizing the guard material utilization is derived from the residue hydrotreating industry, because of asphaltenic molecules which contain the metals and are very thermally sensitive. The lower temperatures result in lower thermal decomposition rates and are believed to give asphaltenic molecules a higher probability of penetrating the catalyst pores before they decompose. The goal is for the metals to be driven into the pore and away from the surface to maximize capture and allow maximum life of the guard reactor. Maximum metal capture is imperative to hydroprocessing and can be a significant factor in establishing cycle lengths and catalyst deactivation rates. The guard reactor also performs some HDS/HDN activity. However, as metals accumulate on the guard materials, this HDS/HDN activity is lost due to poisoning, pore blocking, etc. and may never fully be utilized. Operating the guard reactor at lower temperatures greatly reduces the activity of HDN/HDS, thus placing a greater workload on the treating reactor.

A goal of the present invention is to increase the operational life of the treating reactor. This is accomplished by decoupling the guard reactor from the treating reactor and operating the guard reactor at maximum temperatures from startup. The increased severity will maximize metals capture and optimize the HDN/HDS activity without decreasing the life of the guard reactor because the metal loading remains unchanged. The present invention shows that a guard reactor can be run at high temperatures without losing metal capture. Further, the operation of the guard reactor at the higher temperature will also create HDN and HDS in the guard reactor thus reducing the burden on the treating reactor and ultimately extending the life cycle of the treating reactor and the hydroprocessing system.

The higher temperatures will increase specific de-metalization rates, while decreasing diffusion resistance, allowing even a deeper penetration of metals into the guard catalyst pores. Running at higher temperatures increases HDS and HDN in the guard reactors. At the start of the run there is no metal poisoning and the HDS/HDN activity is maximized. As metals collect in the catalyst the metals will poison/block the pores of the catalyst and the HDN/HDS activity is reduced.

This higher performance of the guard reactors allows for lowering of the operating temperatures in the treating reactors and in the cracking reactors as well. These lower average operating temperatures will result in longer operating cycles for the refiner.

This proposed hydrotreating method is designed for the hydrotreating of gas oil which is a heavy waxy viscous material. It could be applied to other heavy oils or extra heavy oils similarly.

While the guard reactor is not primarily for HDS/HDN, however it does have good activity, approximately 60% of the treating reactor when unpoisoned. The metals poison the guard reactor so rapidly that refiners cannot fully utilize the HDN/HDS activity. Therefore, running the guard at the highest possible severity at the start of the run allows the guard reactor to capture the HDS/HDN activity to the maximum amount. This then allows the treating reactor to be run at a lower severity thereby conserving energy until the guard activity is spent. This utilizes and sacrifices the guard catalyst to lengthen the life of the treater catalyst.

Metals can be removed from any suitable hydrocarbon-containing feed streams. Suitable hydrocarbon containing feed streams include petroleum, petroleum products, coal pyrolyzates, products from extraction and/or liquefaction of coal and lignite, products from tar sands, shale oil, products from shale oil and similar products. Suitable hydrocarbon-containing feed streams include full-range heavy crude oils, topped crudes having a boiling range in excess of about 400° F., and residua. However, the present invention is particularly directed to heavy feed streams such as heavy topped crudes and residua and other materials which are generally regarded as being too heavy to be distilled. These materials will generally contain the highest concentrations of metals such as vanadium and nickel, generally about 5-500 ppmv (parts by weight per million parts by weight of feed) of Ni and 10-1,000 ppmvv of V. In addition, these feed streams generally also contain sulfur compounds (generally about 0.5-8 weight-% S), nitrogen compounds (generally about 0.2-3 weight-% N), and coke precursors (generally about 0.1-30 weight-% Ramsbottom carbon residue; determined according to ASTM D524).

Any suitable pressure can be utilized in the demetallization process of this invention. The reaction pressure will generally be in the range of about atmospheric (0 psig) to about 5,000 psig. Preferably, the pressure will be in the range of from about 100 to about 2500 psig.

Other objects and advantages of the present invention will become apparent to those skilled in the art upon a review of the following detailed description of the preferred embodiments and the accompanying drawings.

IN THE DRAWINGS

FIG. 1 is a schematic of the guard, treating and hydrocracking reactors containing multiple beds.

DETAILED DESCRIPTION OF THE DRAWING

Hydrocarbon feedstock is transferred to a guard reactor 3 via supply lines 1 and 11. In the present application gas oil is the preferred feedstock. The guard reactor 3 is preheated to a temperature in excess of 700° F. Within the guard reactor, the feedstock is reacted with guard catalyst to remove metals. The elevated temperature of the guard reactor increases HDS and HDN activity within the guard reactor 3. HDN and HDS activity in the guard reactor results in less sulfur and nitrogen passing to the treating reactor 5. The HDS and HDN rate is highest within the guard reactor 3 during the start of a run, because there is little to no metal poisoning of the guard catalyst. As metal collects within the guard catalyst, the HDN and HDS rates in the guard reactor will decrease and more sulfur and nitrogen will pass to the treating reactor 5.

The reduced sulfur and nitrogen feedstock is transferred from the guard reactor 3 to the treating reactors where the remaining HDS and HDN occurs. The treating reactor catalyst is used to remove the remaining sulfur and nitrogen. The HDN and HDS activity in the guard reactor 3 reduces the burden on the treating reactor 5 by performing some HDN and HSN prior to the feed entering the treating reactor 5. This increased HDN and HDS activity in the guard reactor 3 allows the treating reactor 5 to operate at less severe conditions and lengthens the life of the treating reactor catalyst, and therefore the treating reactor.

The treated feedstock having reduced or eliminated metal, sulfur and nitrogen content is transferred from the treating reactor 5 to a hydrocracking reactor 7 for further processing.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A process to increase demetallization, hydrodenitrogenation, and hydrodesulfurization of a hydrocarbon feedstock prior to hydrocracking, the process comprising:

heating a guard reactor containing catalyst positioned therein to an elevated temperature exceeding about 700 degrees Fahrenheit;

introducing a hydrocarbon feed containing a hydrocarbon feedstock into the guard reactor, wherein the elevated temperature of the guard reactor increases hydrocarbon feedstock metal penetration into pores of the guard reactor catalyst to increase demetallization of the hydrocarbon feedstock;

operating the guard reactor to create at least partially demetallized, denitrogenated, and desulfurized hydrocarbon feedstock, wherein the elevated temperature of the guard reactor initially increases rates of hydrodenitrogenation and hydrodesulfurization of the hydrocarbon feedstock, such rates of hydrodenitrogenation and hydrodesulfurization gradually decreasing as the guard reactor catalyst is increasingly poisoned by hydrocarbon feedstock metals;

passing the at least partially demetallized, denitrogenated, and desulfurized hydrocarbon feedstock to a treating reactor having catalyst positioned therein;

operating the treating reactor to further denitrogenate and desulfurize the at least partially demetallized, denitrogenated, and desulfurized hydrocarbon feedstock to create a treated hydrocarbon feedstock, wherein life expectancy of the catalyst of the guard reactor is decreased to increase life expectancy of the catalyst of the treating reactor, thereby providing the treating reactor with an increased life span; and sending the treated hydrocarbon feedstock downstream for processing.

2. The process of claim 1 wherein the guard reactor provides hydrodenitrogenation and hydrodesulfurization at up to approximately 60% of treating reactor capacity, thereby providing longer operational cycles for the treating reactor.

3. The process of claim 1 wherein the sending the treated hydrocarbon feedstock downstream for process includes sending the treated hydrocarbon feedstock to a hydrocracking reactor.

4. The process of claim 1 wherein the hydrocarbon feedstock is gas oil.

5. The process of claim 1 wherein the hydrocarbon feedstock is a topped crude oil having a boiling range in excess of 400 degrees Fahrenheit.

6. The process of claim 1 wherein the hydrocarbon feedstock contains vanadium and nickel metals.

7. The process of claim 6 wherein the vanadium is present at between 10 to 1,000 parts per million by weight of feed.

8. The process of claim 6 wherein the nickel is present at between 5 to 500 parts by weight per million of feed.

9. The process of claim 1 wherein the hydrocarbon feedstock includes coke precursors.

10. A process to increase demetallization, hydrodenitrogenation, and hydrodesulfurization of a hydrocarbon feedstock prior to hydrocracking, the process comprising:

heating a guard reactor containing catalyst positioned therein to an elevated temperature exceeding about 700 degrees Fahrenheit;

introducing a hydrocarbon feedstock into the guard reactor, wherein the elevated temperature of the guard reactor increases hydrocarbon feedstock metal penetration into pores of the guard reactor catalyst to increase demetallization of the hydrocarbon feedstock;

operating the guard reactor to create at least partially demetallized, denitrogenated, and desulfurized hydrocarbon feedstock, wherein the elevated temperature of the guard reactor initially increases rates of hydrodenitrogenation and hydrodesulfurization of the hydrocarbon feedstock, such rates of hydrodenitrogenation and hydrodesulfurization gradually decreasing as the guard reactor catalyst is increasingly poisoned by hydrocarbon feedstock metals;

passing the at least partially demetallized, denitrogenated, and desulfurized hydrocarbon feedstock to a treating reactor having catalyst positioned therein;

operating the treating reactor to further denitrogenate and desulfurize the at least partially demetallized, denitrogenated, and desulfurized hydrocarbon feedstock to create a treated hydrocarbon feedstock, wherein life expectancy of the catalyst of the guard reactor is decreased to increase life expectancy of the catalyst of the treating reactor, thereby providing the treating reactor with an increased life span;

sending the treated hydrocarbon feedstock to a hydrocracking reactor; and hydrocracking the treated hydrocarbon feedstock.

11. The process of claim 10 wherein the guard reactor provides hydrodenitrogenation and hydrodesulfurization at up to approximately 60% of treating reactor capacity, thereby providing longer operational cycles for the treating reactor.

12. The process of claim 10 wherein the hydrocarbon feedstock contains vanadium metal and nickel metal.

13. The process of claim 12 wherein the vanadium metal is present at between 10 to 1,000 parts per million by weight of feed.

14. The process of claim 12 wherein the nickel metal is present at between 5 to 500 parts by weight per million of feed.

15. The process of claim 10 wherein the hydrocarbon feedstock is gas oil.

16. The process of claim 10 wherein the hydrocarbon feedstock is a topped crude oil having a boiling range in excess of 400 degrees Fahrenheit.

17. The process of claim 10 wherein the hydrocarbon feedstock includes coke precursors.

18. A process to increase demetallization, hydrodenitrogenation, and hydrodesulfurization of a hydrocarbon feedstock prior to hydrocracking, the process comprising:

heating a guard reactor containing catalyst positioned therein to an elevated temperature that exceeds about 700 degrees Fahrenheit;

introducing a hydrocarbon feedstock containing one or more metals into the guard reactor;

operating the guard reactor at the elevated temperature to increase rates of hydrodenitrogenation and hydrodesulfurization of the hydrocarbon feedstock and to increase penetration of at least a portion of the one or more metals from the hydrocarbon feedstock into pores of the guard reactor catalyst, the rates of hydrodenitrogenation and hydrodesulfurization of the hydrocarbon feedstock decreasing as the at least a portion of the one or more metals collects in the pores of the guard reactor catalyst;

passing at least partially demetallized, denitrogenated, and desulfurized hydrocarbon feedstock to a treating reactor having catalyst positioned therein;

operating the treating reactor at a treating reactor temperature that is reduced from the elevated temperature to further denitrogenate and desulfurize the at least partially demetallized, denitrogenated, and desulfurized hydrocarbon feedstock and create a treated hydrocarbon feedstock, the elevated temperature of the guard reactor reducing life expectancy of the guard reactor catalyst as compared to life expectancy of the treating reactor catalyst; and sending the treated hydrocarbon feedstock downstream to a hydrocracker.

19. The process of claim 18, wherein the elevated temperature is near a maximum operating temperature of the guard reactor.

20. The process of claim 18, further comprising:

operating the guard reactor at a pressure between about 100 psig and about 2,500 psig.

* * * * *